US007868146B2

(12) United States Patent
Scheibel et al.

(10) Patent No.: US 7,868,146 B2
(45) Date of Patent: Jan. 11, 2011

(54) METHOD AND DEVICE FOR PRODUCING A THREAD FROM SILK PROTEINS

(75) Inventors: Thomas Scheibel, Bayreuth (DE); Daniel Huemmerich, Mannheim (DE)

(73) Assignee: Amsilk GmbH, Munich (DE)

( * ) Notice: Subject to any disclaimer, the term of this patent is extended or adjusted under 35 U.S.C. 154(b) by 136 days.

(21) Appl. No.: 11/991,916

(22) PCT Filed: Sep. 13, 2006

(86) PCT No.: PCT/EP2006/008924

§ 371 (c)(1),
(2), (4) Date: May 14, 2008

(87) PCT Pub. No.: WO2007/031301

PCT Pub. Date: Mar. 22, 2007

(65) Prior Publication Data

US 2009/0137781 A1 May 28, 2009

(30) Foreign Application Priority Data

Sep. 13, 2005 (DE) ..... 10 2005 043 609

(51) Int. Cl.
*A23J 1/00* (2006.01)
*C07K 14/00* (2006.01)

(52) U.S. Cl. ..... 530/412; 530/350

(58) Field of Classification Search ..... None
See application file for complete search history.

(56) References Cited

FOREIGN PATENT DOCUMENTS

| | | |
|---|---|---|
| EP | 1 609 801 | 12/2005 |
| WO | 01/38614 | 5/2001 |
| WO | 03/060099 | 7/2003 |
| WO | 2004/057069 | 7/2004 |
| WO | 2005/017237 | 2/2005 |

OTHER PUBLICATIONS

Knight et al. "Beta transition and stress-induced phase separation in the spinning of spider dragline silk"; International Journal of Biological Macromolecules, 2000, vol. 27, pp. 205-210.*
Huemmerich et al. "Primary Structure Elements of Spider Dragline Silks and Their Contribution to Protein Solubility", Biochemistry, 2004, vol. 43, pp. 13604-13612.*

* cited by examiner

*Primary Examiner*—Suzanne M. Noakes
(74) *Attorney, Agent, or Firm*—Baker & Daniels LLP

(57) ABSTRACT

The present invention relates to a thread preparation process from silk proteins including an apparatus which is appropriate for performing the method. Furthermore, the invention is directed to the threads obtained therewith as well as the use thereof. The invention uses a diffusion unit leading to the production of high-quality silk threads with high yield.

14 Claims, 7 Drawing Sheets

METHOD AND DEVICE FOR PRODUCING A THREAD FROM SILK PROTEINS

CROSS-REFERENCE TO RELATED APPLICATIONS

The subject application is the §371 national stage filing of PCT/EP2006/008924 filed Sep. 13, 2006, which also claims priority to DE 10 2005 043 609.9, filed Sep. 13, 2005.

FIELD OF THE INVENTION

The present invention relates to a method for preparing a thread from silk proteins as well as an apparatus which is appropriate for performing the method. Moreover, the invention is directed to the threads obtained therewith as well as to the use thereof.

BACKGROUND OF THE INVENTION

Natural silk, e.g. spider silk, is an extraordinary material having a very high tensile strength in combination with a high extensibility. Due to these properties it has been tried for many years to prepare this material in larger amounts. Since it is not possible to use animals as e.g. spiders for this purpose, research is focussing on the investigation of methods in which the starting material for silk (e.g. spider silk) proteins is obtained recombinantly and then spun to a thread.

As raw materials there are used authentic silk proteins (recombinant proteins which are obtained by means of authentic sequences of the silk gene) and synthetic silk proteins (proteins based on synthetic genes, wherein their primary sequence widely corresponds to the natural sequences). The quality of an artificially produced thread is assumed to be defined by both the raw material used and the spinning method applied.

As in the natural spinning process, in the artificial spinning process, the silk proteins have to be transferred from a soluble form into an insoluble form, the structure of which shall be as identical to the authentic thread as possible. For this, the working group of Jelinski has developed a micro spinning apparatus which allowed spinning a few milligrams of silk proteins to silk threads with a length of several meters (Liivak et al., 1998). Silk of the spider *Nephila clavipes* dissolved in hexafluoroisopropanol was used as a starting material. The so dissolved protein was injected in a precipitation bath of acetone through a spinning nozzle. However, the threads obtained therewith were very refractory and did hardly show any structural similarity to natural silk threads (Seidel et al., 1998; Seidel et al, 2000). Primarily, by treating it with water and supplementary drawing the thread (post spin draw), both mechanical and structural parameters could be improved. However, the properties of natural silk have not been achieved (Seidel et al., 2000).

Another group developed a spinning technique, in which a methanol/water mixture was used as a precipitation bath. With this, a synthetic silk protein and a recombinant MaSp1 of the spider *Nephila clavipes* could be spun from an urea-containing solution. However, these were also refractory (Arcidiacono et al., 2002).

By using the same technique, recombinant ADF-3 being solved without chaotropic reagents could be spun to threads. Also in this case, the properties of the thread could be improved by post spin draw (Lazaris et al., 2002), though the tensile strength of natural threads has not been achieved. The companies Oxford Biomaterials (Oxford, Great Britain), Spin 'Tech GmbH (Ludwigsburg, Germany) and the Institut für Mikrotechnik Mainz GmbH (Mainz, Germany) have developed a method according to the state of knowledge of the inventors, with which silk proteins can be spun to threads by a microdialysis method or a similar method.

Additionally, there are successful trials to obtain threads from silk proteins by means of the so called electro-spinning (Prof. Frank Ko, Drexel University, Philadelphia, Pa., U.S.A.). However, there has not been disclosed anything about the mechanical properties of the so produced threads yet.

US 2003/0201560 relates to an apparatus for spinning threads from protein solutions. It is stated that the apparatus has a funnel-formed section through which the protein solution or "dope", respectively, is passed, wherein this passage is at least partially consisting of a semipermeable and/or porous material.

WO 2005/017237 inter alia relates to an apparatus for assembling proteins. The apparatus has a tubular passage, the walls of which are partially permeable or porous. This has the advantage of monitoring the pH, the water content and the ion composition.

WO 2004/057069 relates to a method and an apparatus for preparing objects, especially also for spinning threads from spider silk proteins. This method essentially relates to the sol-gel transition of the protein solution which is for example achieved by adding potassium, preferably potassium fluoride. Furthermore, it is stated here that the apparatus used for performing the method has a semipermeably or porously formed "transition compartment".

WO 2003/060099 refers to the preparation of spider silk fibres or bio-filaments, respectively. In the apparatus given, there is described an "extrusion unit" through which the spider silk protein solution is passed. WO 2003/060099 is especially directed to inserting the filaments in a coagulation bath after air contact.

Consequently, the previously used and publicated methods for spinning spider silk proteins mostly base on the injection of a protein solution in a precipitation bath. For stabilizing the soluble state of the proteins in the spinning solution, the precipitation bath usually contains chaotropic substances or organic solvents. For compensating the effect of these additives and inducing the protein assembly, lyotropic agents are accordingly added to the precipitation bath.

BRIEF SUMMARY OF THE INVENTION

In contrast, it is an object of the present invention to provide a method and an apparatus for preparing silk proteins which make the use of the precipitation bath and the addition of natural, chaotropic or lyotropic agents unnecessary. It is another object of the present invention to prepare stable silk proteins having mechanical properties which approximate or correspond to natural silk proteins by means of a method and an apparatus. An additional object of the invention is the preparation of silk threads with a high yield, i.e. in such an amount which is appropriate for large scale preparation.

These objects are solved by the subject-matter of the independent claims. Preferred embodiments are given in the dependent claims.

As stated above, the previously used methods for spinning spider silk proteins mostly base on the injection of a protein solution in a precipitation bath, wherein the precipitation bath usually contains chaotropic, lyotropic substances or organic solvents for stabilizing the soluble state of the proteins in the spinning solution.

It has been found that by contrast, the natural silk assembly, e.g. in the spider, is mediated by other factors. A key process is a phase separation of the spinning solution induced by adding potassium and phosphate ions into an aqueous, protein-poor and a protein-rich phase. The elongation of the protein-rich phase by subsequently drawing the finished thread leads to the assembly of the silk proteins.

The mechanical properties of the artificially spun threads according to prior art which are comparatively poor when compared to natural spider silk indicate that phase separation and elongation are important factors for the formation of mechanically stable structures. However, this finding has not been used for producing silk threads yet.

The approach of the present invention contains several differences when compared to the spinning methods of the prior art described above.

The method according to the invention is exclusively based on aqueous solution without addition of non-natural chaotropic or lyotropic agents. Without wishing to be bound by any theory, the proteins are presumably present in a conformational state corresponding to the natural state due to that.

Changes of the composition of the spinning solution will be effected via diffusion. Thus, the solution can be transferred to an assembly-competent state without having to immediately take a solid state, as this is the case in a precipitation bath.

The thread assembly is completed by drawing the partially assembled protein-rich phase. Form studies on chemical polymers there is known that an elongation of concentrated polymer solutions results in an alignment of the single polymer chains and thus to an increased stability of the fibre formed therefrom. Thus, it has to be supposed that the spinning method used herein, which is based on drawing, outclasses the methods based on pressure.

The spinning apparatus of the present invention allows for the production of high-performance fibres from synthetic spider silk to be used in many fields of technology and industry. Beside ballistic applications such as the development of bulletproof equipment, synthetic spider silks could be used for parachutes, special ropes and nets, sporting goods, textiles, but for light construction components as well.

The present invention relates to the following aspects and embodiments:

According to a first aspect, the present invention relates to a method for the preparation of a thread from silk proteins, comprising the following steps:

a) providing a solution of silk proteins;

b) transferring the solution into a diffusion unit containing a composition comprising potassium and phosphate ions;

c) passing the solution through the diffusion unit, wherein the solution comes into contact with the potassium and phosphate ions diffusing out of the diffusion unit;

d) separating the solution into a silk protein-rich and poor phase;

e) obtaining the silk thread from the protein-rich phase.

Obtaining the silk thread is preferably carried out by drawing.

It should be noted that the term "silk protein", as it is used in this application, is principally not subjected to any limitations. The only requirement is the ability of the protein to assemble to a thread under appropriate conditions. In the closer sense, the silk proteins are characterised by proteins from natural or recombinant origin, respectively, e.g. proteins which are, for example, derived from arachnids (Arachnida) or insects (Insecta). Examples of the origin of the protein are the silkworm (*Bombyx mori*), the green lacewings (*Chrysoperla carnea*), the *araneus* (*Araneus diadematus*) and the golden orb-web spider (*Nephila clavipes*).

The silk proteins used herein can be authentic, i.e. constitute the natural sequences, or can be synthetic, i.e. proteins based on synthetic genes, wherein their primary sequences widely correspond to the natural sequence.

The single silk protein sequences are accessible for a person skilled in the art via databases, wherein it is only exemplarily referred to the sequences ADF-3 and ADF-4 of *Araneus diadematus* which are accessible under the Nos. U47855 and U47856.

The term "diffusion unit", as it is used herein, describes a storage medium enabling the diffusion of components out of this and into this. The diffusion unit of the present invention is not the porous or semipermeable membrane conventionally used in the prior art through which an unilateral passage of components without storage properties shall be enabled. The diffusion unit of the present invention can rather be termed as a matrix, in which, on the one hand, there are provided the potassium and phosphate ions necessary for the formation of protein-rich and poor phases, and in which the protein-poor phase (not to be used for the thread assembly) is taken up on the other hand.

In one embodiment, the spinning solution provided in a) contains at least 1%-50%, preferably 10-40%, most preferably 10-20% (w/v) silk protein. From experience, the pH of the solution ranges from 4.0-12.0, preferably from 6.5-8.5 and is most preferably 8.0. The solution is also called "dope". "Dope" means a fluid or solution which, besides protein monomers, can additionally include protein aggregates, for example dimers, trimers and/or tetramers. Additionally to the solvents listed below, this protein solution can also include additives as e.g. preservatives as well as agents for enhancing the stability or the processability of the solution.

In the method according to the invention, the solution preferably comprises a polar solvent selected from water, alcohols and mixtures thereof. Examples of alcohols comprise methanol, ethanol, propanol, isopropanol or polyvalent alcohols such as glycerol or propylene glycol. Besides their solvent properties, the last-mentioned solvents can also be used as agents for setting the viscosity and/or as preservatives.

According to a preferred embodiment, the step of obtaining the silk thread includes the contacting of the protein-rich phase with a gas or a fluid. Usually, the gas will be an oxygen-containing gas, i.e. in a case, wherein an oxidizing action inter alia is desired. On the other hand, the gas can also be an inert gas such as e.g. nitrogen, argon, helium etc. Mixtures of these gases are also contemplated.

In addition to the contact with the gaseous substances, a contact with fluids, examples of which are methanol, ethanol, propanol, isopropanol, acetone, acetonitrile and preferably methanol, may be contemplated.

In an especially preferred embodiment, the diffusion unit of the present invention is formed from a gel material. A preferably used gel material is a hydrogel, especially a hydrogel comprising polyacrylamide, cellulose derivative, polyvinylmethylether (PVME), polystyrene-polybutadiene (PS-PB), stearylacrylate, polyethylene (PE), polystyrene (PS), polyvinylalcohol (PVA), polyacrylic acid, poly(N-vinylpyrrolidone) (PVP), polyethyleneterephthalate (PET), polyisopropyleneacrylamide, polyethersulfonic acid and/or silicone hydrogels.

Alternatively, the diffusion unit can be formed from ceramics.

According to a second aspect, the present invention relates to an apparatus for performing the method defined above, with:

a first device transferring a solution of silk proteins into the diffusion unit;

a diffusion unit having a channel for passing the solution which channel is surrounded by the potassium and phosphate ions containing composition, wherein the solution comes into contact with the potassium and phosphate ions diffusing out of the diffusion unit, so that the diffusion unit provides a solution separated into a silk protein-rich and poor phase at the outlet of its channel; and a second device generating the silk thread from the protein-rich phase of the solution.

According to one preferred embodiment of the apparatus according to the invention, the first device is formed as a syringe coupled to a controllable pump. For example, a control device, as for example a micro-controller, controls the controllable pump. The control device preferably has a memory, in which a sequential program for actuating the controllable pump can be stored.

According to one preferred embodiment, the first device is formed as a controllable pump system transferring the solution in a continuous process into the diffusion unit. Especially, the control program described above is formed in such a way that it controls and thus ensures the continuous process for transferring the solution into the diffusion unit.

According to another embodiment, the diffusion unit has a diminution or a nozzle at the outlet of its channel by which the discharge of the solution out of the diffusion unit is controllable. The nozzle or diminution is constructed in such a way, that its cross sectional areas diminish outwardly.

According to another preferred embodiment, the second device is formed as a roll or a reel actuated by an actuating device, which draws the silk thread out of a drop formed at the outlet of the diffusion unit from the protein-rich phase of the solution. Especially, the actuating device is also coupled to the control device such that the sequential program stored in the memory of the control device also controls the actuating device, thereby especially ensuring the continuous process of drawing the thread.

According to another preferred embodiment, the roll or reel draws the spider silk thread by means of a tensile force necessary for the protein assembly.

According to another preferred embodiment, the diffusion unit is formed as an exchangeable cartridge.

According to another preferred embodiment, the actuating device has a motor and/or a gear box.

According to another preferred embodiment, the channel of the diffusion unit has a substantially constant inside diameter for passing the solution.

Herewith, the approach of the present invention especially differs from the state of the art, e.g. the US 2003/0201560, wherein the tubular section is illustrated in all embodiments as a funnel. It is specifically pointed out that the orientation of the molecules in a fibre can be improved when a nozzle having a convergent geometry can be used. Preferably, the present invention does not follow this approach.

According to another preferred embodiment, the diffusion unit has a third device with which the protein-rich phase can be removed from the diffusion unit.

According to another preferred embodiment, the third device is formed as a vacuum pump.

In a third aspect, the present invention relates to a thread obtainable by the method according to one or more of claims 1-10. This thread is preferably used in technology and industry for ballistic applications such as the development of bulletproof equipment for the manufacture of parachutes, special ropes and nets, sporting goods textiles, medicine technology, but also for light construction components of aircrafts.

BRIEF SUMMARY OF THE FIGURES

The present invention will now be illustrated with the use of figures and examples. The figures show the following:

FIG. 5 represents an analysis of the assembled thread, wherein FIG. 5A shows thread 7 wound up by means of the teflon roll 6, and FIG. 5B shows a scanning electron microscopic picture of the generated thread. FIG. 6 shows natural silk from *A. diadematus* wherein FIG. 6(A) shows the silk before the tensile test, FIG. 6(B) shows the silk after disrupting the sample; FIG. 6(C) shows a cross section; and FIGS. 6(D-F) show synthetic silk (AQ)24NR3 sample 1 wherein FIG. 6(D) shows the sample before the tensile test, FIG. 6(E) shows silk sample 1 after disrupting the sample; and FIG. 6(F) shows a cross section.

In all figures, identical or functionally identical elements and devices, respectively, are assigned with the same reference numerals—unless it is stated otherwise.

DETAILED DESCRIPTION OF THE INVENTION

Figure 1:
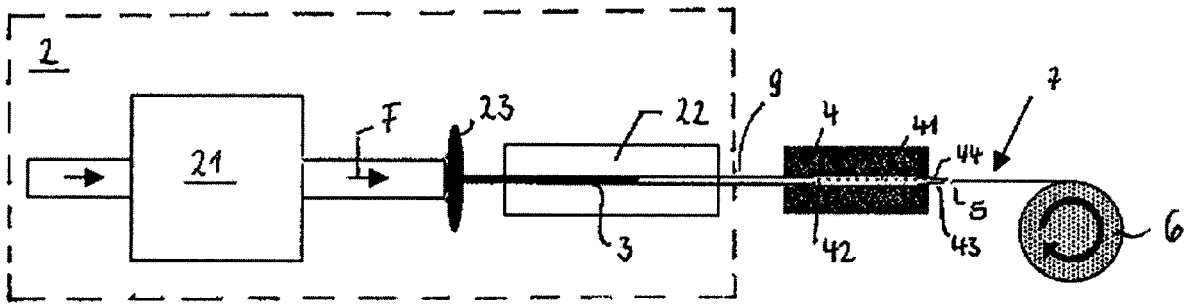
FIG. 1 is a schematic block diagram of an exemplary embodiment of the apparatus according to the invention for the manufacture of a thread from silk proteins.

In FIG. 1, there is shown a schematic block diagram of a preferred exemplary embodiment of the apparatus according to the invention.

The apparatus 1 according to the invention for performing the method for the preparation of a silk thread 7 from silk proteins has a first device 2, a diffusion unit 4 and a second device 6.

The first device 2 transfers the solution 3 of silk proteins into the diffusion unit 4. The first device 2 is preferably formed as a syringe 22 coupled to a controllable pump 21. A reservoir 23 for the solution 3 is preferably disposed between the pump 21 and the syringe 22. According to FIG. 1, the reference number F refers to the flow direction of the solution 3 in the reservoir 3. The first device 2 can further be formed as a controllable pump system that transfers the solution 3 in a continuous process into the diffusion unit 4. The pump system preferably has at least one hose pump.

For example, the first device 2 is connected to the diffusion unit 4 via a cannula 8.

The diffusion unit 4 has a channel 41 for passing the solution 3. The channel 41 is surrounded by a potassium and phosphate ion containing composition 42. The solution 3 comes into contact with the potassium and phosphate ions diffusing out of the diffusion unit 4, so that the diffusion unit 4 provides a solution 3 separated into a silk protein-rich phase 5 and a silk protein-poor phase at the outlet 43 of its channel 41. Preferably, the diffusion unit 4 has a diminution or nozzle 44 at the outlet 43 of its channel 41 by which the leaving of the solution 3 out of the diffusion unit 4 is controllable, especially due to its geometrical construction.

Further, the apparatus 1 according to the invention has a second device 6 generating the silk thread 7 from the protein-rich phase 5 of the solution 3. Especially, the second device 6 is formed as a roll or a reel actuated by an actuating device, which draws the silk thread 7 from a drop which is formed from the protein-rich phase 5 of the solution 3 at the outlet 43 of the diffusion unit 4. The roll 6 especially draws the silk thread by means of a tensile force necessary for the protein assembly. The actuating device actuating the roll 6 especially has a motor and/or a gear box.

Figure 2:
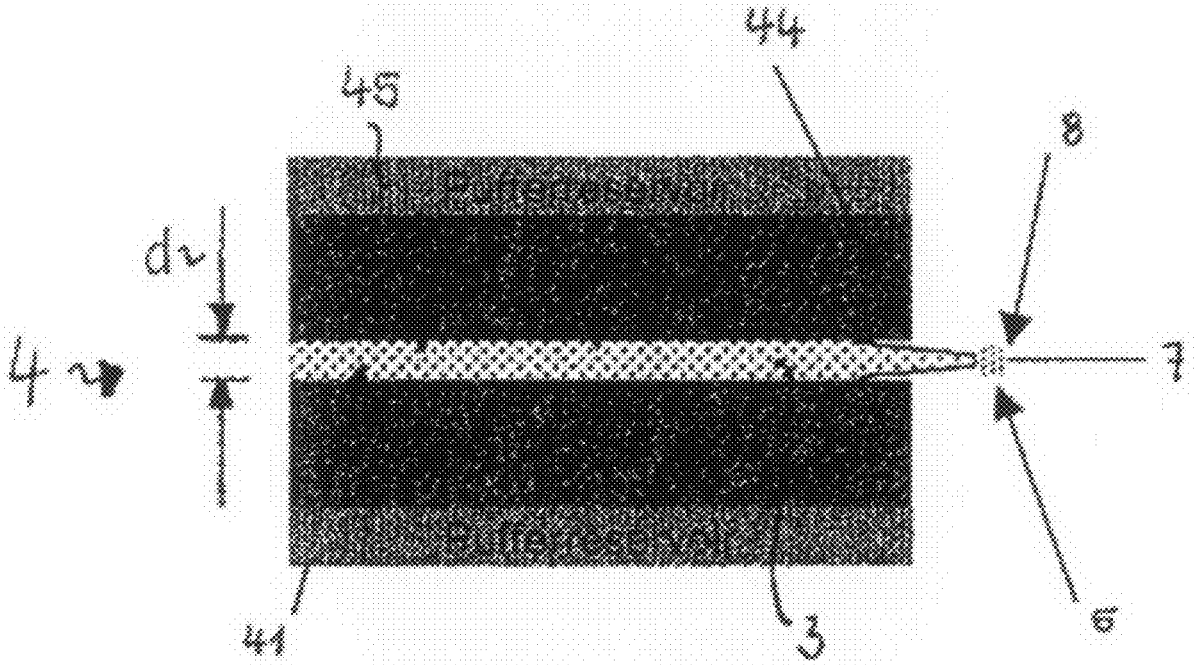
FIG. 2 is a schematic block diagram of an exemplary embodiment of the diffusion unit according to the present invention.

FIG. 2 shows a more preferred exemplary embodiment of the diffusion unit 4 shown in FIG. 1. The inside diameter d of the channel 41 serving for passing the solution 3 is preferably substantially constant.

The diffusion unit 4 is preferably formed as an exchangeable cartridge so that the diffusion unit 4 can especially be exchanged when it is saturated with the protein-poor phase of the solution 3. The diffusion unit 4 especially has a third device by which the protein-poor phase of the diffusion unit 4 can be removed. For example, this third device is formed as a vacuum pump. Additionally, the unit shown in FIG. 2 refers to a buffer reservoir having the reference number 45.

EXAMPLES

The invention described herein integrates these processes into a spinning method allowing the automatic production of mechanically resilient protein threads.

FIG. 1 shows a schematic diagram of the spinning method of the invention in form of an embodiment. This method substantially includes four components. A controllable motor/gear box unit provides for continuous supply of the spinning solution in a diffusion unit via a syringe. In this unit, which consists of a gel, potassium and phosphate ions diffuse into the spinning solution resulting in a phase separation. The protein-rich and poor phases will be further transported to the outlet of the diffusion unit and there, they will come into contact with air. This contact is essential for the spinning process and presumably leads to the reduction of the aqueous phase by drying processes.

A thread can be drawn from the formed drop of the protein-rich phase (FIG. 2). By winding up the thread onto a roll being actuated via a controllable motor, the tension necessary for the protein assembly can be maintained and a continuous thread formation can be achieved. FIG. 2 shows elements of the diffusion unit according to one embodiment of the invention.

Figure 3:
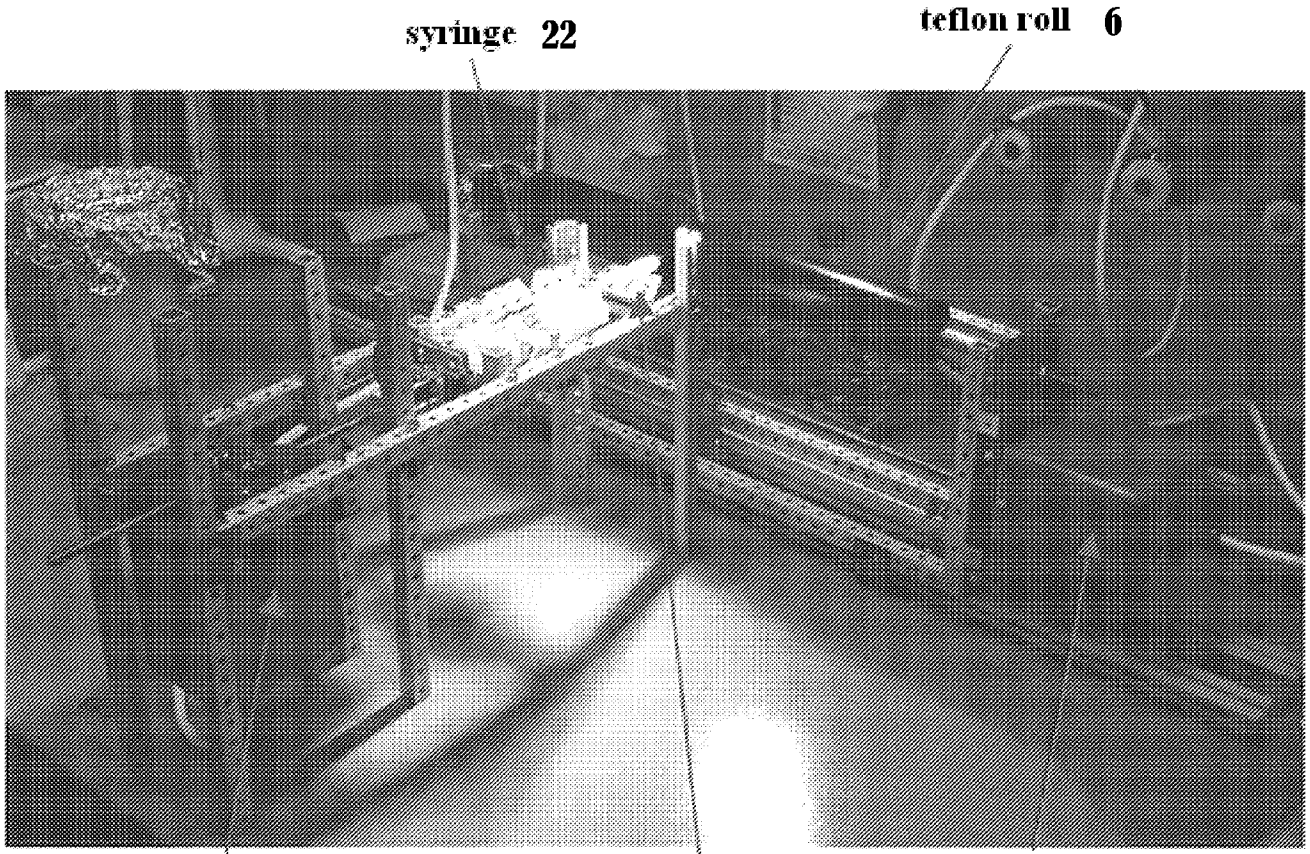
FIG. 3 is a photographic picture of an apparatus of the present invention.

The functional capability of the presented technique could be shown by the construction of a prototype (FIG. 3). The motor and gear box unit as well as the scaffold of the prototype were assembled from elements of a metal construction kit (Compakt Technik GmbH, Schriesheim, Germany). A 25 μl glass syringe having a metal needle (gauge 22, Point Style 3; Hamilton, Bonadutz, Switzerland) was used for supplying the spinning solution. FIG. 3 shows a preferred embodiment of the invention.

Figure 4:
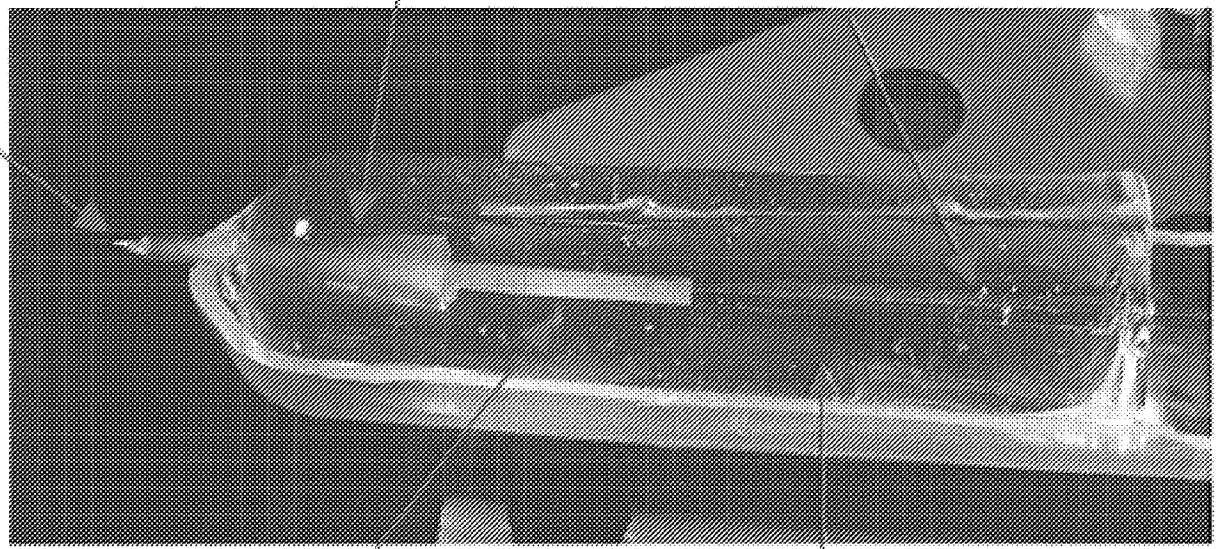
FIG. 4 is a photographic picture of a diffusion unit of the present invention.

The diffusion unit consists of a 20% polyacrylamid gel being equilibrated in 0.5 M potassium phosphate pH 8.0. A channel having a diameter of 0.7 mm was passed through the gel and ended in a plastic tip with an inside diameter of about 0.2 mm (FIG. 4). The protein thread is wound up by a teflon roll having a diameter of 4 cm and rotating with 60 rpm. FIG. 4 shows a summary about the diffusion unit.

Figure 5:
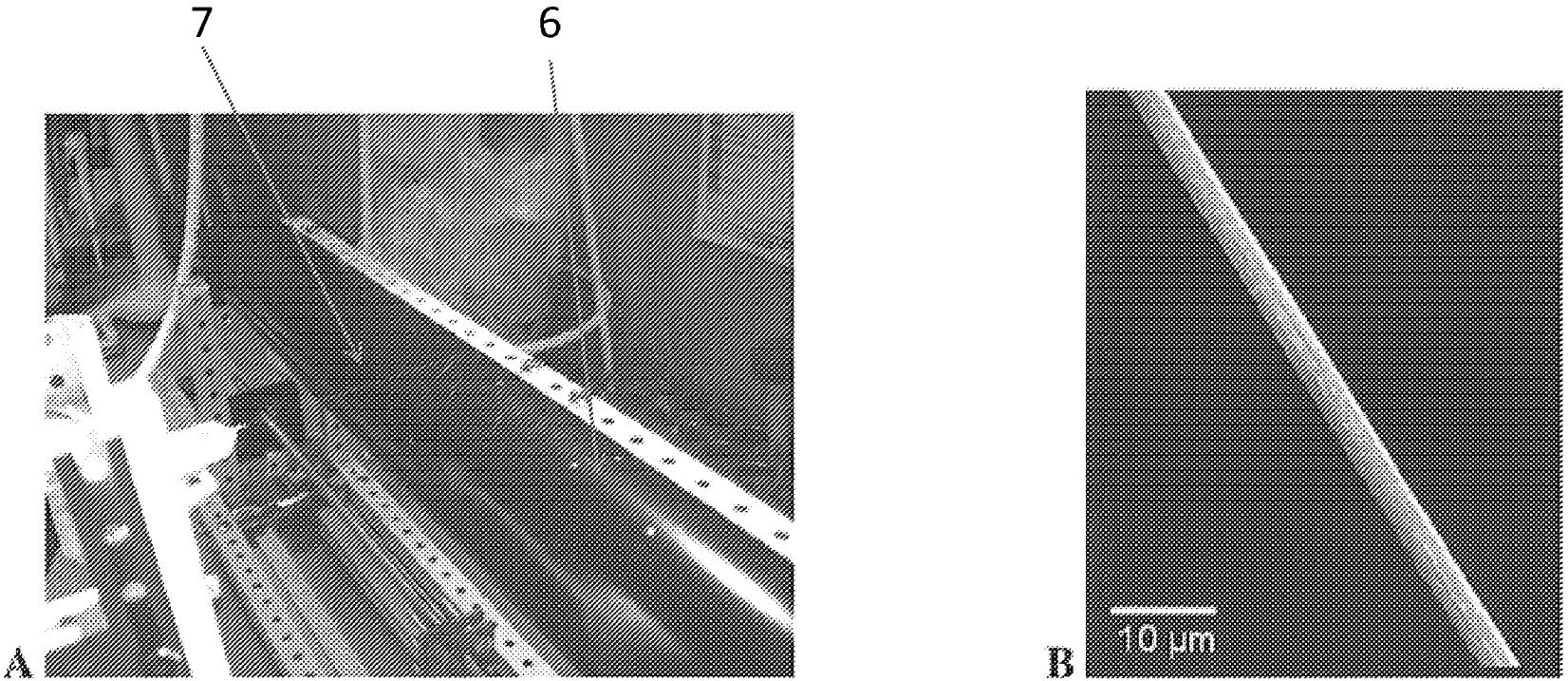

With this prototype, a 25% solution of the synthetic silk protein $(AQ)_{24}$NR3 (see Huemmerich et al., 2004) could be spun to a 4 μm thick thread. FIG. 5 presents an analysis of the assembled thread. (A) The thread is wound up by means of the teflon roll. (B) Scanning electron microscopic picture of the generated thread.

Figure 5C:
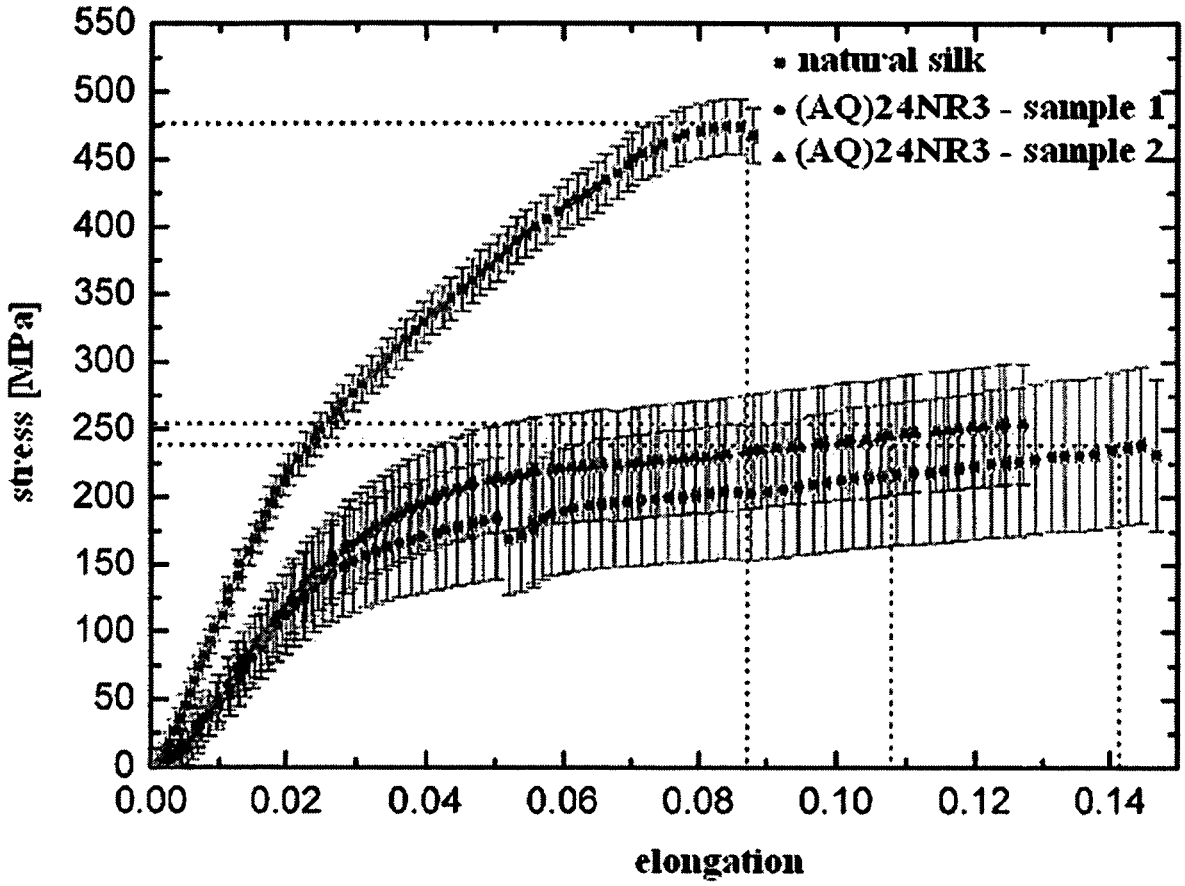
FIG. 5C shows mechanical properties of the natural silk of the European garden spider (*Araneus diadematus*) compared to the fibres of the synthetic silk $(AQ)_{24}NR3$ after spinning in the spinning apparatus.
Figure 6:
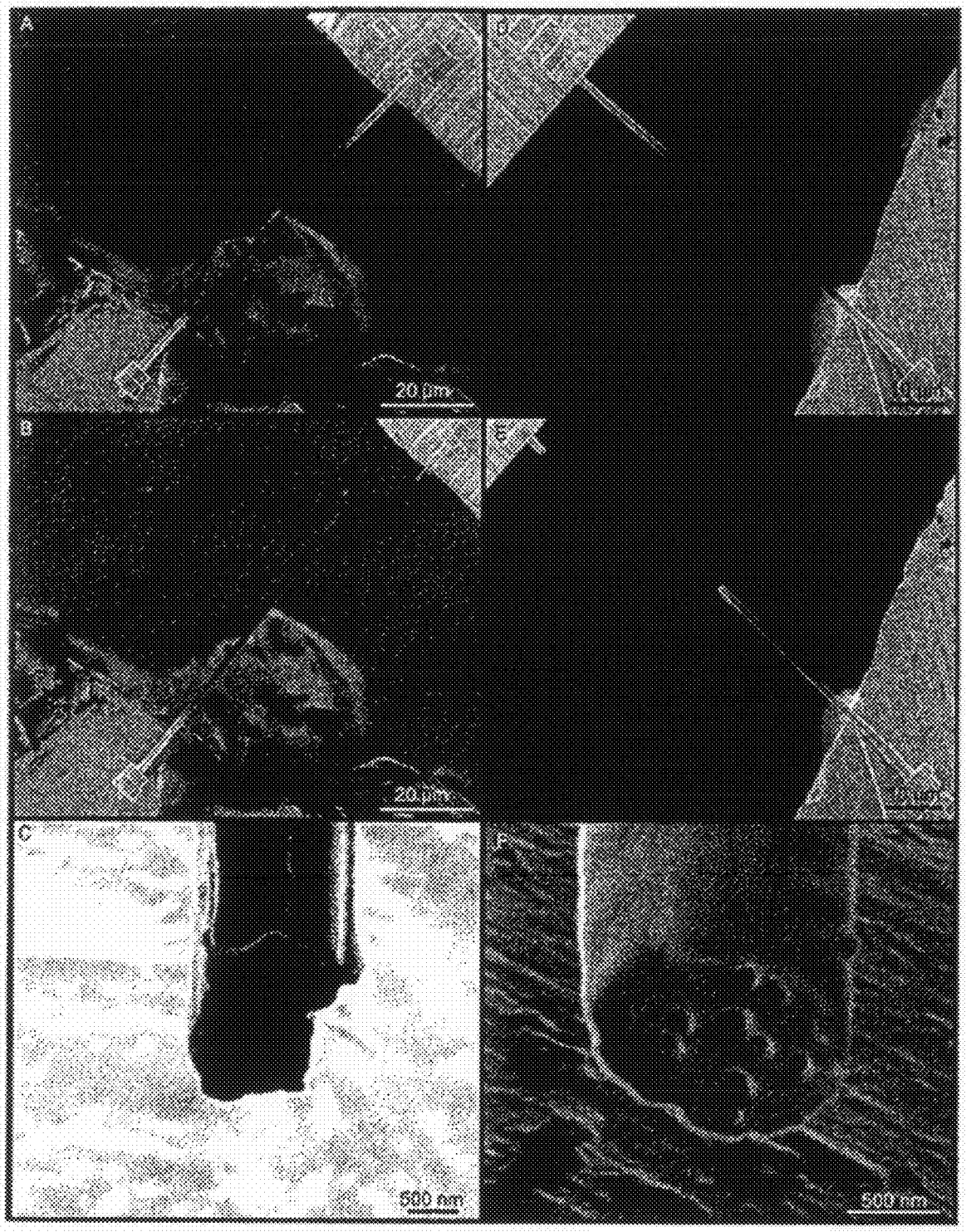

Mechanical properties of the natural silk of the European garden spider (*Araneus diadematus*) compared to the fibres of the synthetic silk $(AQ)_{24}$NR3 after spinning in the spinning apparatus described (see FIG. 5C):

| material | average area [$\mu m^2$] | Young's Module [GPa] | tensile strength [MPa] | elongation at rupture [%] | robustness [$J/m^2$] | tensile energy absorption [$MJ/m^3$] |
|---|---|---|---|---|---|---|
| naturals silk from: *Araneus diadematus* | 2.5 ± 0.1 | 11.9 ± 0.9 | 474 ± 20 | 8.96 ± 0.06 | 1232 ± 50 | 28.7 |
| $(AQ)_{24}$NR3 sample 1 | 1.7 ± 0.4 | 6.9 ± 1.4 | 238 ± 58 | 14.1 ± 0.1 | 1029 ± 242 | 25.4 |
| $(AQ)_{24}$NR3 sample 2 | 1.8 ± 0.2 | 8.2 ± 2.0 | 254 ± 45 | 10.8 ± 0.1 | 1169 ± 154 | 24.5 |

REFERENCES

Arcidiacono, S., Mello, C. M., Butler, M., Welsh, E., Soares, J. W., Allen, A., Ziegler, D., Laue, T. & Chase, S. (2002) Aqueous processing and fiber spinning of recombinant spider silks. *Macromolecules* 35: 1262-6.

Huemmerich, D., Helsen, C. W., Quedzuweit, S., Oschmann, J., Rudolph, R. & Scheibel, T. (2004) Primary structure elements of spider dragline silks and their contribution to protein solubility. *Biochemistry* 43: 13604-12

Lazaris, A., Arcidiacono, S., Huang, Y., Zhou, J. F., Duguay, F., Chretien, N., Welsh, E. A., Soares, J. W. & Karatzas, C. N. (2002) Spider silk fibers spun from soluble recombinant silk produced in mammalian cells. *Science* 295: 472-6

Liivak, O., Blye, A., Shah, S. & Jelinski, L. W. (1998) A Microfabricated Wet-Spinning Apparatus To Spin Fibers of Silk Proteins. Structure-Property Correlations. *Macromolecules* 31: 2947-51

Seidel, A., Liivak, O. & Jelinski, L. W. (1998) Artificial Spinning of Spider Silk. *Macromolecules* 31: 6733-6

Seidel, Al., Liivak, O., Calve, S., Adaska, J., Ji, G. D., Yang, Z. T., Grubb, D., Zax, D. B. & Jelinski, L. W. (2000) Regenerated spider silk: Processing, properties, and structure. *Macromolecules* 33: 775-80

Vollrath, F. & Knight, D. P. (2001) Liquid crystalline spinning of spider silk. *Nature* 410: 541-8

What is claimed is:

1. A method for the preparation of a thread from recombinant silk proteins, comprising the following steps:

a) providing a solution of recombinant silk proteins;

b) transferring the solution into a diffusion unit containing a composition comprising potassium and phosphate ions;

c) passing the solution through the diffusion unit, wherein the solution comes into contact with the potassium and phosphate ions;

d) separating the solution into a silk protein-rich and poor phase;

e) obtaining the silk thread form the protein-rich phase.

2. The method according to claim 1, wherein the spinning solution contains at least 1%-50% (w/v) silk proteins.

3. The method according to claim 1, wherein the spinning solution contains 10-40% (w/v) silk proteins.

4. The method according to claim 1, wherein the spinning solution contains 10-20% (w/v) silk proteins.

5. The method according to claim 1, wherein the pH of the solution is 4.0-12.0.

6. The method according to claim 1, wherein the pH of the solution is 6.5-8.5.

7. The method according to claim 1, wherein the pH of the solution is 8.0.

8. The method according to claim 1, wherein the solution comprises natural or synthetic silk proteins.

9. The method according to claim 8, wherein the silk proteins are derived from the species *Bombyx mori, Araneus diadematus*, and/or *Nephila clavipes*.

10. The method according to claim 1, wherein the solution comprises a polar solvent which is preferably selected from water, alcohols and mixtures thereof.

11. The method according to claim 1, wherein the production of the silk thread includes contacting the protein-rich phase with a gas or a fluid.

12. The method according to claim 11, wherein the gas is selected from $O_2$, inert gases or mixtures thereof.

13. The method according to claim 1, wherein the diffusion unit is formed of a gel material or ceramics.

14. The method according to claim 13, wherein the gel material is selected from hydrogels, especially from polyacrylamide, cellulose derivatives, polyvinylmethylether (PVME), polystyrene-polybutadiene (PS-PB), stearylacrylate, polyethylene (PE), polystyrene (PS), polyvinylalcohol (PVA), polyacrylic acid, poly(N-vinylpyrrolidone) (PVP), polyethyleneterephthalate (PET), polyisopropyleneacrylamide, polyethersulfonic acid, silicone hydrogels.

* * * * *